US006036432A

United States Patent [19]

Sishtla et al.

[11] Patent Number: 6,036,432

[45] Date of Patent: Mar. 14, 2000

[54] METHOD AND APPARATUS FOR PROTECTING CENTRIFUGAL COMPRESSORS FROM ROTATING STALL VIBRATIONS

[75] Inventors: Vishnu M. Sishtla, Cicero; Joost J. Brasz, Fayetteville, both of N.Y.

[73] Assignee: Carrier Corporation, Syracuse, N.Y.

[21] Appl. No.: 09/112,516

[22] Filed: Jul. 9, 1998

[51] Int. Cl.[7] ..... F01D 17/08

[52] U.S. Cl. ..... 415/26; 415/17; 415/29; 415/47; 415/48; 415/49; 415/119

[58] Field of Search ..... 415/17, 26, 29, 415/47, 48, 49, 119

[56] References Cited

U.S. PATENT DOCUMENTS 5,618,160 4/1997 Harada et al. ..... 415/17
5,683,223 11/1997 Harada et al. .
5,851,103 12/1998 Harada et al. ..... 415/17

*Primary Examiner*—Edward K. Look
*Assistant Examiner*—Matthew T. Shanley

[57] ABSTRACT

A fluid passage extends through the compressor casing from a point near the tip of the impeller to a transducer located externally of the compressor casing. Responsive to fluctuations of pressure sensed by the transducer indicative of rotating stall, the compressor is controlled by varying the diffuser or shutting down the compressor, as is appropriate.

7 Claims, 8 Drawing Sheets

METHOD AND APPARATUS FOR PROTECTING CENTRIFUGAL COMPRESSORS FROM ROTATING STALL VIBRATIONS

BACKGROUND OF THE INVENTION

A typical compressor performance map is a graphical representation of percent of rated head plotted with efficiency contours against percent of rated volumetric flow at various speeds. The point on the performance map at which the compressor operates with maximum efficiency is the design point. The selection or rating point is the point on the performance map at which the compressor is being applied to a particular system. It is not unusual for refrigeration compressors to be selected for heads and capacities above their peak efficiency regions. The maximum flow rates approach a limiting value determined by the relative velocity of the refrigerant entering the impeller since, as this velocity approaches a sonic value, the flow becomes choked and further increases become impossible. In a compressor equipped with pipe or vaned diffuser downstream of the impeller, maximum flow is determined by choked flow in the diffuser passage.

Under partial load conditions, satisfactory compressor operation is limited by an instability known as surge in which the refrigerant alternately surges backward and forward through the compressor accompanied by noise, vibration and heat. Surging can be distinguished from other kinds of noise and vibration by the fact that its flow reversals alternately unload and load the driver. Motor current varies markedly during surging, and turbines alternately speed up and slow down.

Another kind of instability that occurs in centrifugal compressors is incipient surge or stall which may occur near, but at lighter loading than, the true surge envelope. This phenomenon involves the formation of rotating stall pockets or cells in the diffuser. Rotating stall is an essentially two dimensional instability in which regions of reduced or reversed mass flow rotate around the compressor annulus. Typically, the frequency of rotating stall is much higher than the frequency of surge. A roaring noise is produced at a frequency determined by the number of cells formed and the impeller running speed. The driver load is steady but excess vibration results from rotating stall.

U.S. Pat. No. 5,683,223 discloses surge detection apparatus employing multiple sensors. More specifically, pressure is measured in the diffuser on the suction and pressure sides. Differences between pressures measured by different sensors is determined and these signals along with others representing other parameters are used to detect surge. In order to protect industrial compressors from operating in rotating stall, non-contact proximity probes may be used to measure the vibration. The major disadvantages are cost and compatibility of the transducer with refrigerants.

SUMMARY OF THE INVENTION

It has been determined that there is a, nominal, one-to-one relationship between shaft vibration and either pressure fluctuations or rotating stall. Since shaft vibration is a result of rotating stall and corresponds to pressure fluctuations, the present invention uses a simple pressure signal measured near the impeller tip or between the impeller and the diffuser to detect rotating stall and as a basis for controlling the compressor to correct rotating stall and to avoid progressing into surge. More specifically, pressure fluctuations sensed by a single sensor are tracked and if a pressure fluctuation of a predetermined amount (eg. 15 psi) occurs a predetermined number of times (eg. six) within a predetermined time period (eg. three minutes), rotating stall is considered to be occurring and appropriate changes in operation are made.

It is an object of this invention to protect compressors from rotating stall vibrations.

It is a further object of this invention to increase the efficiency of a centrifugal machine.

It is another object of this invention to detect rotating stall with a single pressure sensor. These objects, and others as will become apparent hereinafter, are accomplished by the present invention.

Basically, a standard pressure transducer is used to sense impeller tip pressure in a compressor. Since pressure fluctuations are related to rotating stall, the onset or approach of rotating stall can be determined by fluctuations in the sensed pressure within a determined time period and treated by shutting down the machine or changing the operating conditions of the compressor.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
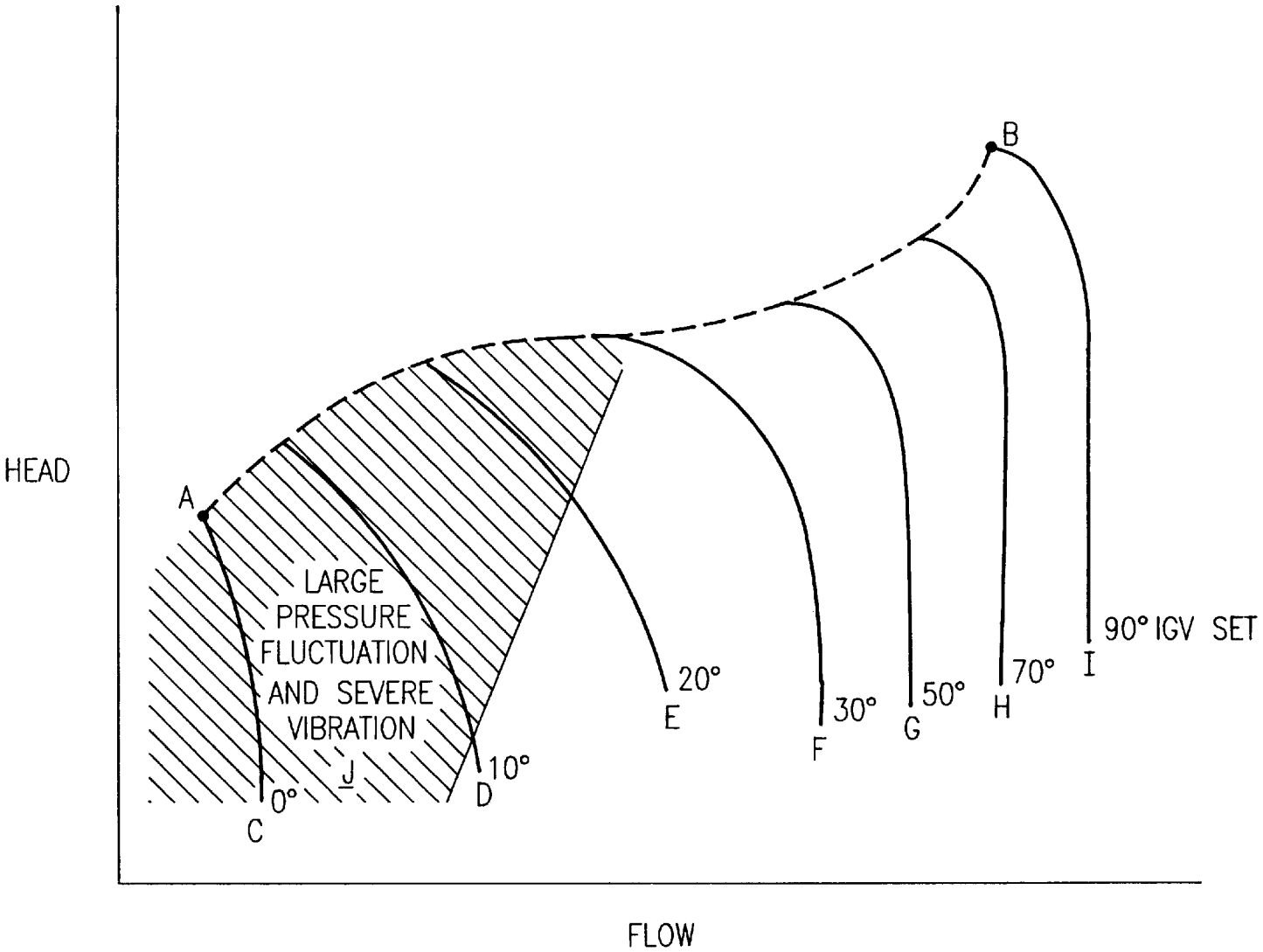
FIG. 1 is a plot of head vs. volumetric flow showing the surge envelope and stall region of a centrifugal compressor with variable-geometry inlet guide vanes and a fixed-geometry discrete-passage diffuser for inlet guide vane setting angles between 0° and 90°.
Figure 2:
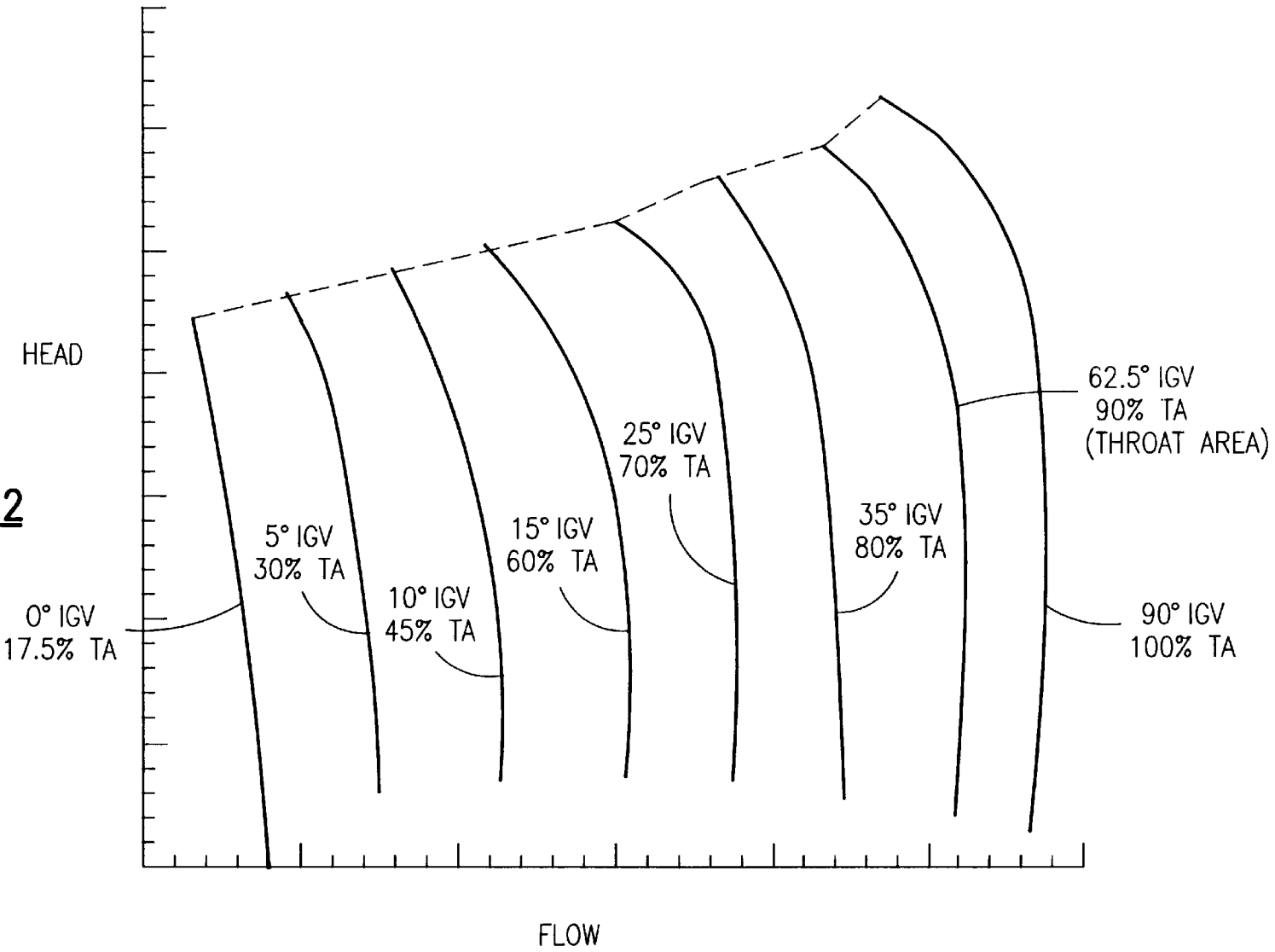
FIG. 2 is a plot of head vs. volumetric flow of a centrifugal compressor with variable-geometry inlet guide vanes (setting angle between 0° and 90°) and variable-geometry discrete passage diffuser (throat area between 17.5 and 100%)

FIG. 1 is a plot of head vs. volumetric flow and line A-B represents the boundary of the surge envelope. Lines C, D, E, F, G, H and I represent inlet guide vane settings of 0°, 10°, 20°, 30°, 50°, 70° and 90°, respectively. The inlet guide vane angle is measured from the tangential direction with 90° representing fully open. Region J represents a region of large pressure fluctuation as well as the severe vibration associated with rotating stall. The plot of head vs. volumetric flow as shown in FIG. 1 represents the performance map of a centrifugal compressor with a fixed geometry discrete passage diffuser. If the diffuser geometry is made variable, the surge line of the compressor map becomes much more horizontal and the region of large internal pressure fluctuations and the corresponding severe mechanical vibrations associated with rotating stall is eliminated from the compressor performance map as is shown in FIG. 2. FIG. 2 shows the performance map for a given relationship between inlet guide vane setting angle (changing from 90°=full open to 0°=fully closed) and variable geometry diffuser position indicated as a percentage of full load throat area (changing from 100% at maximum capacity to 17.5% at minimum compressor capacity).

An additional object of the present invention is to guarantee compressor performance as shown in FIG. 2 and to prevent operation in the rotating stall/vibration zone of FIG. 1 which could only occur during malfunctioning of either the variable inlet guide vane actuator or the variable geometry diffuser actuator.

Figure 3:
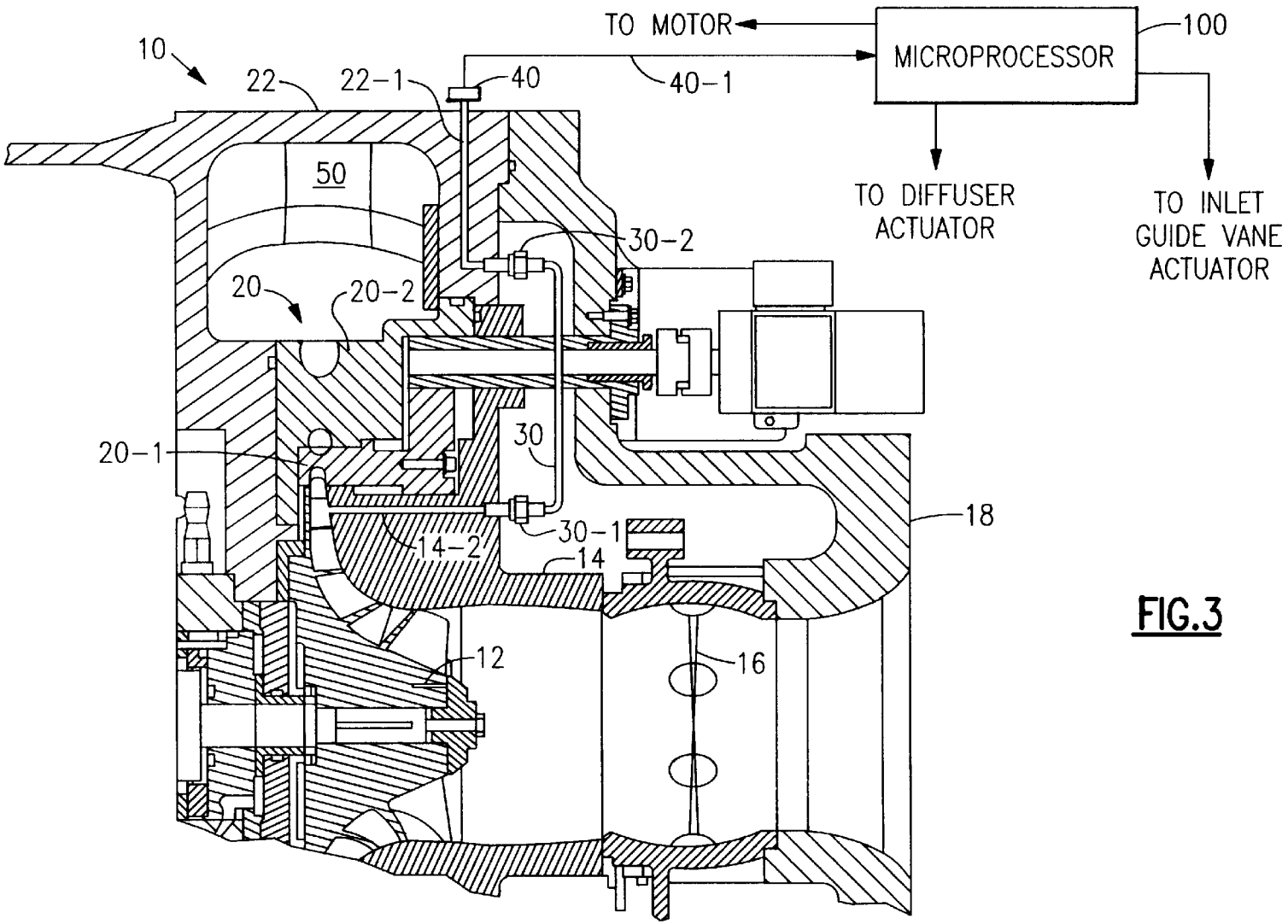
FIG. 3 is a partial sectional view of a centrifugal compressor employing the present invention.
Figure 4:
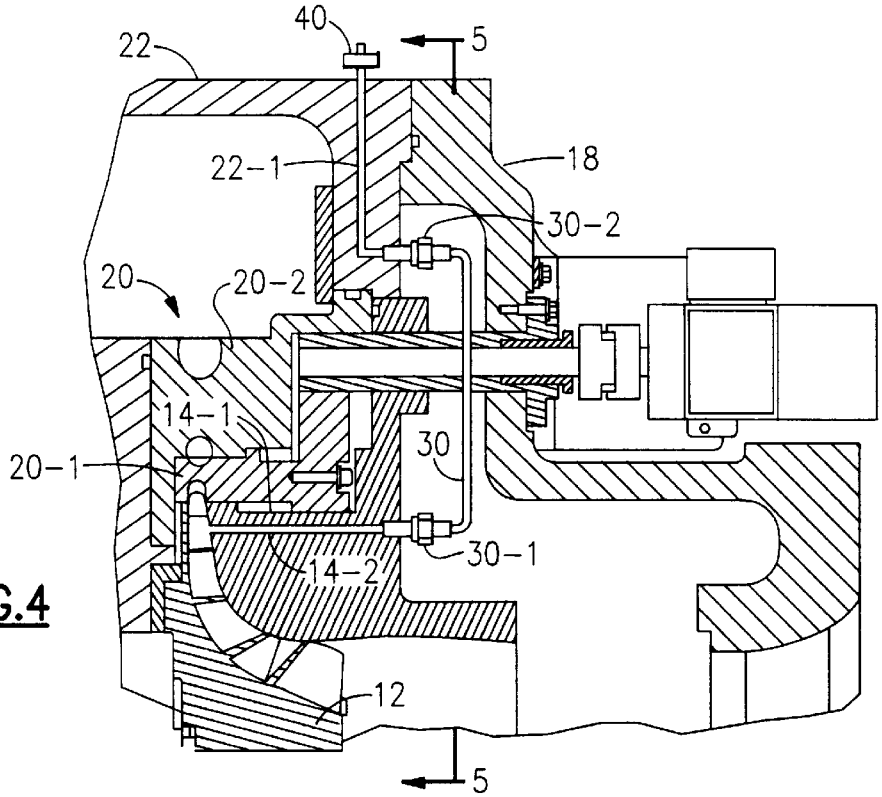
FIG. 4 is an enlarged view of a portion of FIG. 3.
Figure 5:
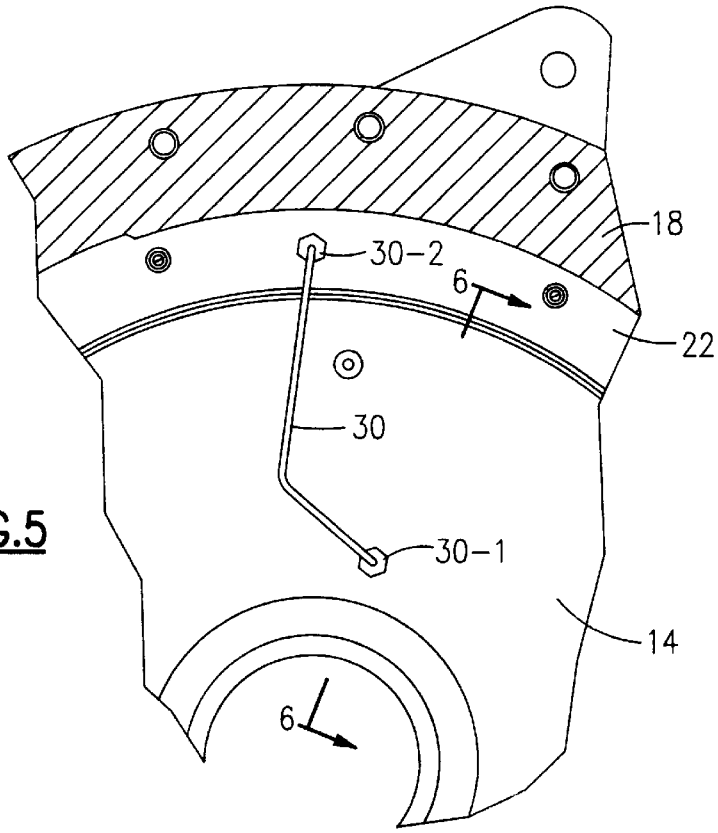
FIG. 5 is a sectional view taken along line 5—5 of FIG. 4.
Figure 6:
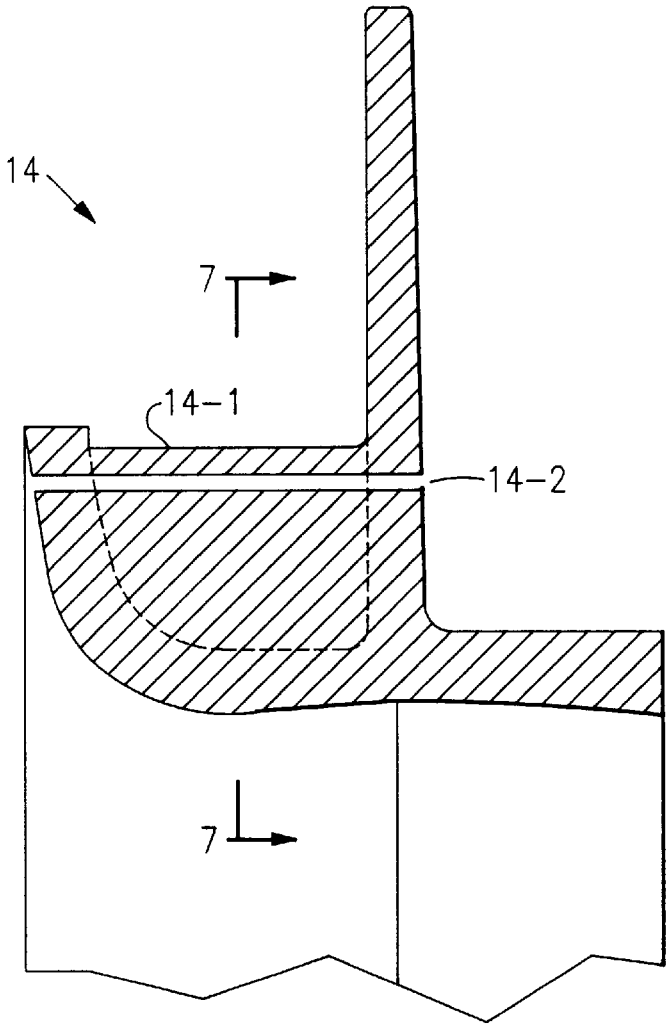
FIG. 6 is a sectional view taken along line 6—6 of FIG. 5.
Figure 7:
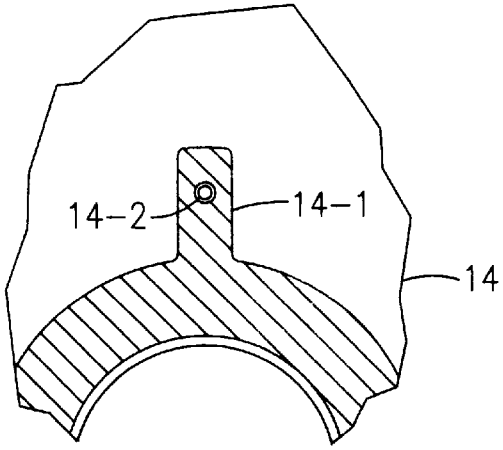
FIG. 7 is a sectional view taken along line 7—7 of FIG. 6.

In FIG. 3, the numeral 10 generally designates a centrifugal compressor which is under the control of microprocessor 100. Compressor 10 includes an impeller 12 which extends into shroud 14. Inlet guide vanes 16 are located in suction housing 18 upstream of impeller 12 and are controlled via microprocessor 100 to control flow into compressor 10 and to provide an inlet swirl to the flow entering impeller 12. Pipe diffuser 20 is located radially outward of the tip of impeller 12. Pipe diffuser 20 includes an inner ring 20-1 and an outer ring 20-2 with at least one of the rings rotatable with respect to the another. When one ring is rotated with respect to the other, the alignment between each pair of complementary inlet flow channels of the inner and outer rings 20-1 and 20-2, respectively, is changed and flow therethrough is regulated.

As described so far, compressor 10 is generally conventional. Referring now to FIGS. 3–7, the present invention adds radially and axially extending rib 14-1 to shroud 14. A hole 14-2 is drilled in a generally axial direction through rib 14-1 with one end of the hole 14-2 being located near the tip of impeller 12, in assembled compressor 10. The one end of hole or bore 14-2 is, in a preferred embodiment, nominally, at a radius around 5% smaller than the radius of the tip of impeller 12. The circumferential location of hole or bore 14-2 is not critical nor is the preferred radial location of 95% of impeller tip radius which is primarily chosen for ease of forming hole and bore 14-2. On the suction side of shroud 14, fitting 30-1 is threaded or otherwise suitably connected to bore 14-2 so as to fluidly connect bore 14-2 and tube 30. Tube 30 is fluidly connected via fitting 30-2 to L-shaped drilled passage 22-1 in compressor base 22. A standard pressure transducer 40 is located externally of compressor 10 and is fluidly connected to passage 22-1 in any suitable manner and is thereby in fluid communication with the tip of impeller 12 via bore 14-2, tube 30 and passage 22-1. Transducer 40 is electrically connected to microprocessor 100 via line 40-1.

In operation, flow to compressor impeller 12 is controlled by inlet guide vanes 16 which act as valves in controlling the flow while providing a spin to the flow. The spin provided to the flow increases with decreasing inlet guide vane angle which corresponds to reduced flow. Assuming, the guide vanes 16 are at 90°, aligned with the flow, they provide no valving action and provide no spin to the flow. As inlet guide vanes 16 move towards closing they produce an inlet swirl on the flow entering impeller 12. Impeller 12 is rotatably driven by a motor (not illustrated). The rotation of impeller 12 draws gaseous refrigerant into compressor 10 via inlet guide vanes 16 and forces the compressed refrigerant outwardly through diffuser 20 into scroll 50 and then to the refrigeration system (not illustrated). As noted above, the inlet guide vanes 16, diffuser 20 and the motor (not illustrated) driving impeller 12 are controlled by microprocessor 100 responsive to inputs representing system conditions.

Figure 8:
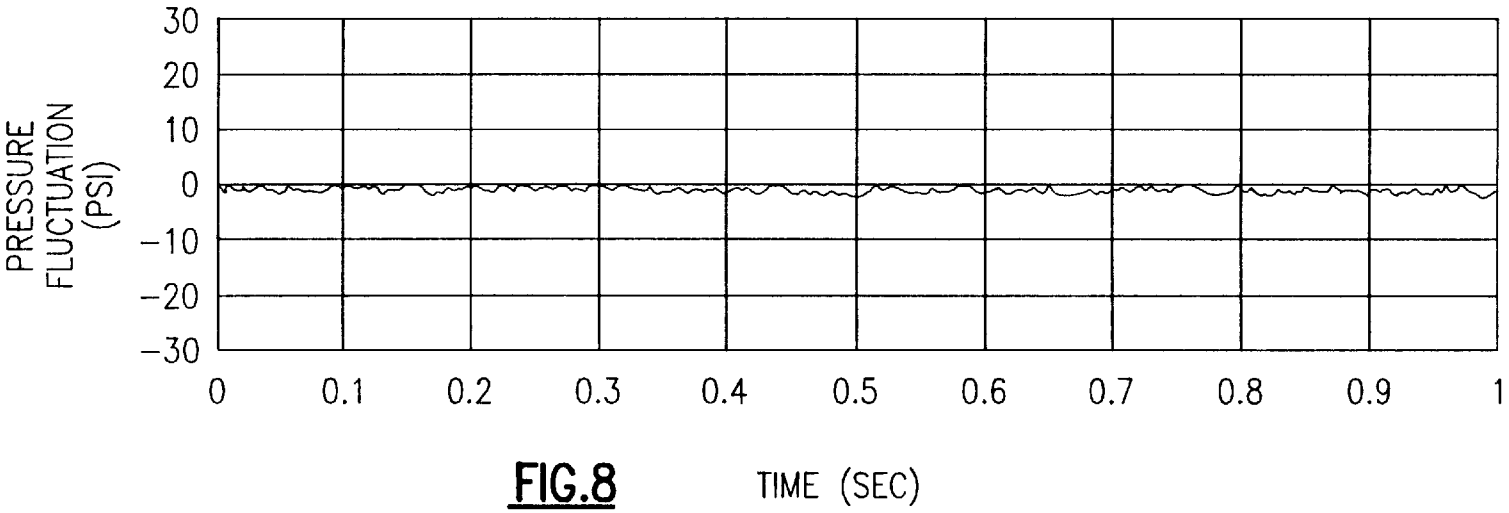
FIG. 8 is a plot of pressure fluctuation in psi vs. time over a one second period during normal operation.
Figure 9:
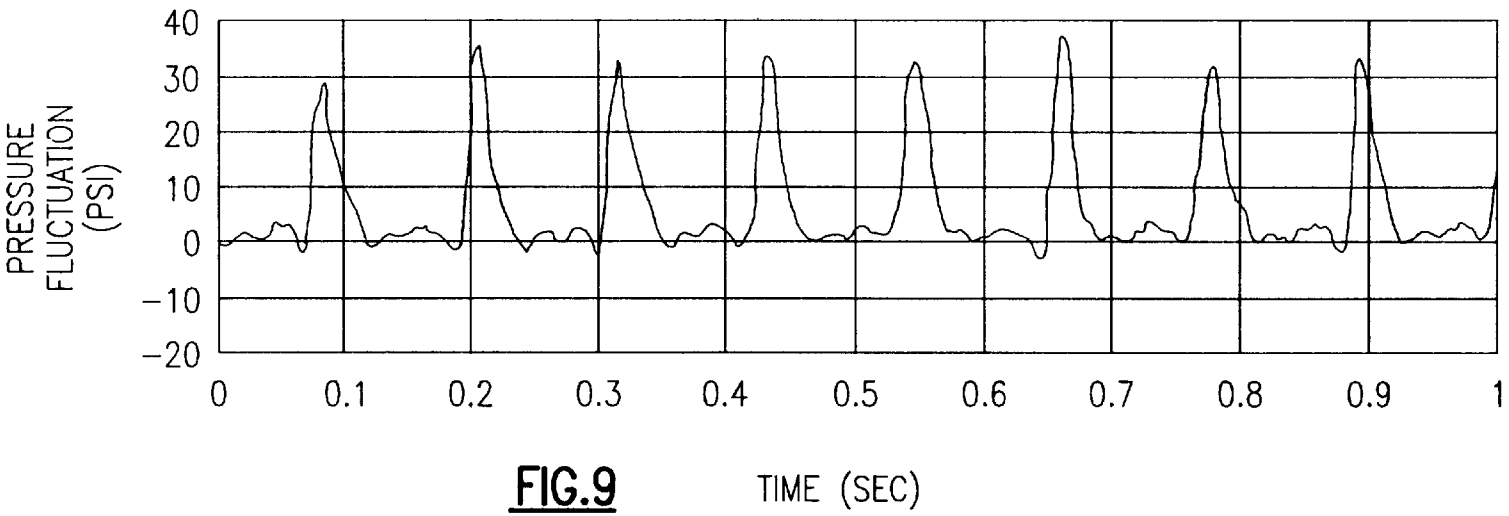
FIG. 9 is a plot of pressure fluctuation in psi vs. time over a one second period during rotating stall.
Figure 10:
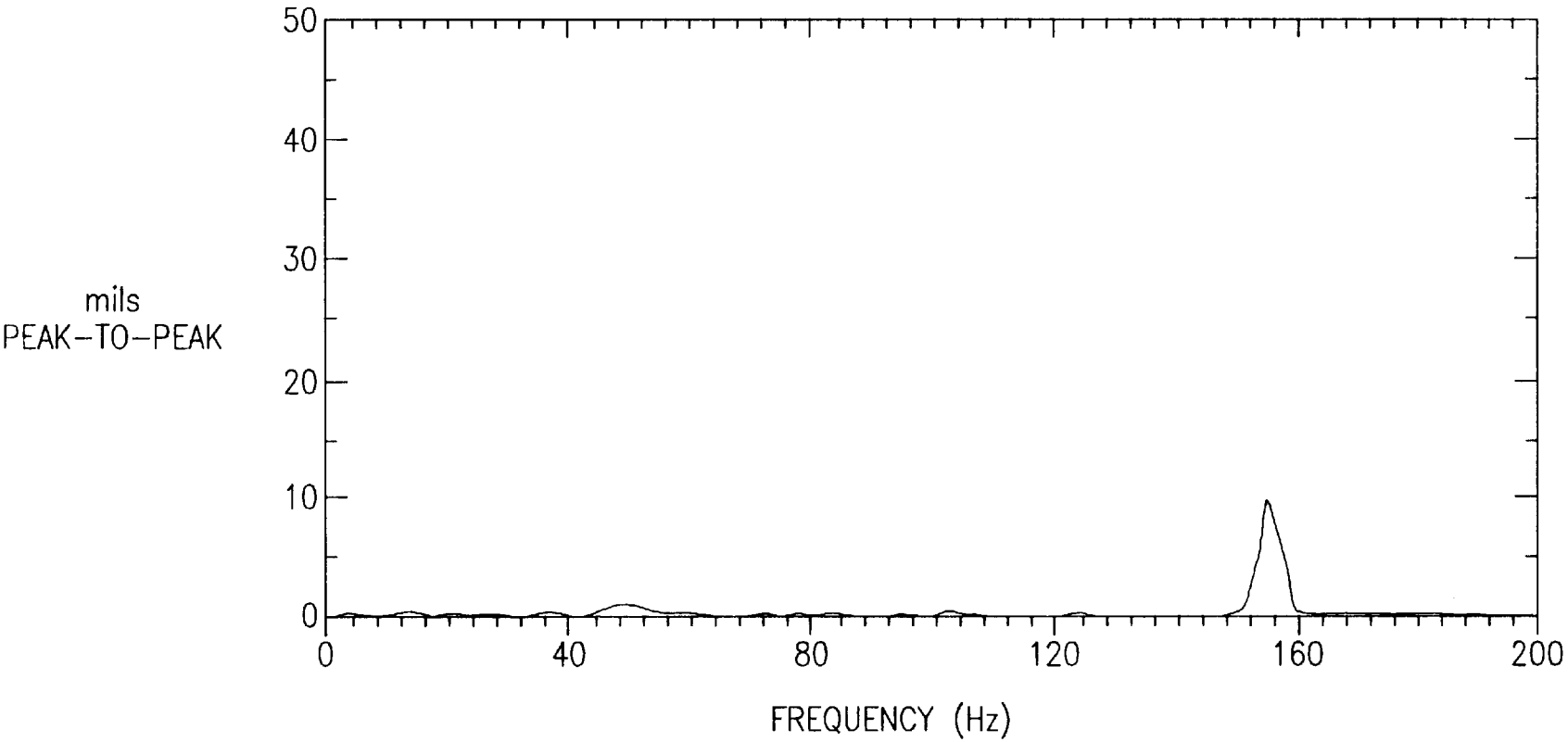
FIG. 10 is a plot of shaft vibration in a radial direction in mils, peak to peak, vs frequency during normal operation.
Figure 11:
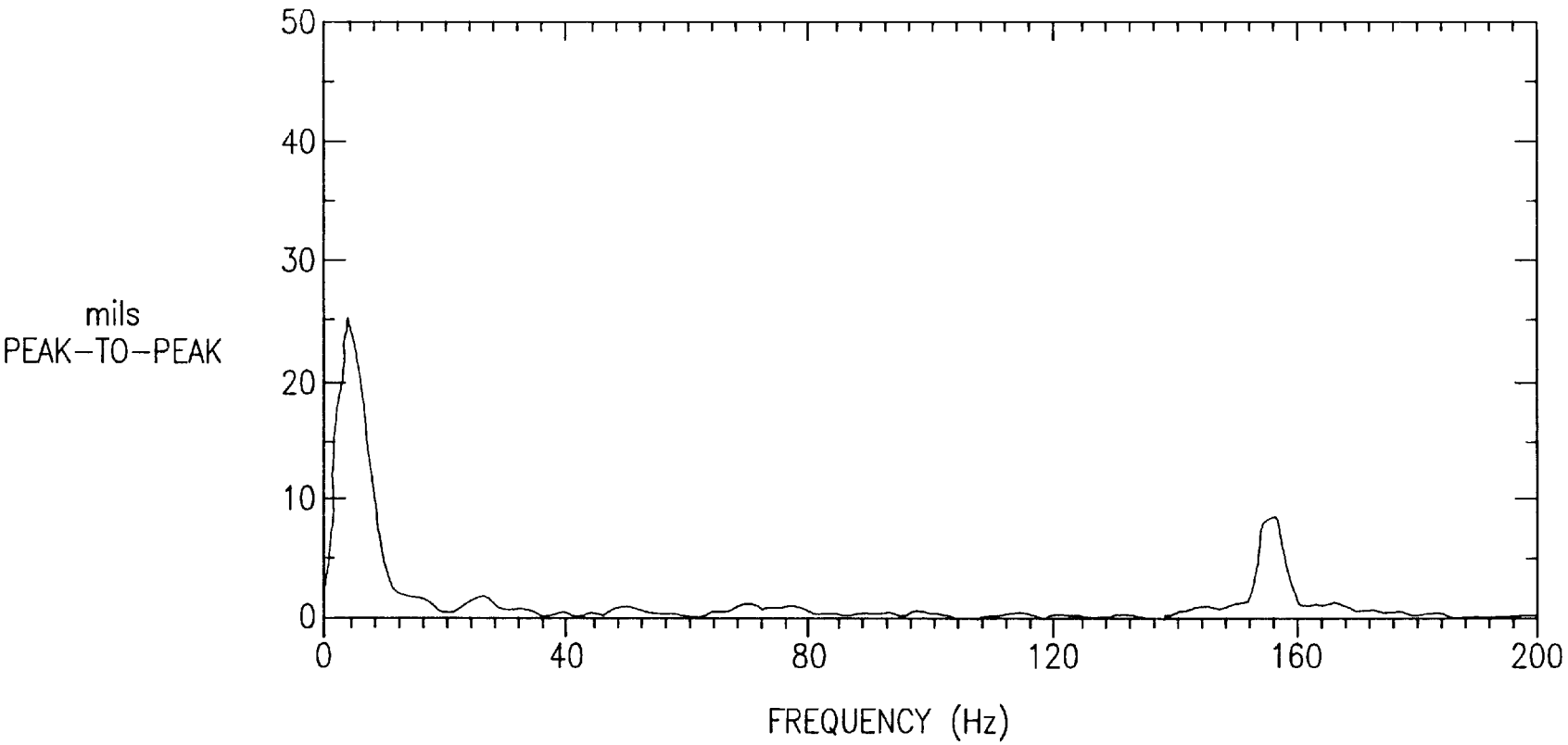
FIG. 11 is a plot of shaft vibration in a radial direction, in mils, peak to peak, vs. frequency during rotating stall.

Using transducer 40 to sense static pressure corresponding to the dynamic impeller tip pressure due to the physical separation between the end of hole 14-2 and transducer 40, FIG. 8 shows pressure, in psi, vs. time, in seconds, for a one second period under steady state operating conditions. FIG. 9 corresponds to FIG. 8 except that compressor 10 is in a condition of rotating stall. In comparing FIGS. 8 and 9, it will be noted that in FIG. 8 the pressure is relatively constant. In FIG. 9, however, the pressure is a series of short, mildly varying segments spaced by significant pressure spikes. Since a pressure spike may be an anomaly, the preferred practice of the present invention requires a plurality of spikes of a predetermined magnitude within a predetermined time period. In practice, the occurrence of six or more spikes indicating a pressure excursion of at least 15 psi within a three minute period is an acceptable indication of rotating stall. Shaft vibrations determined using a non-contacting probe validate the readings of FIG. 9 as detecting rotating stall. FIG. 10 shows vibration amplitude in mils, peak to peak, vs. frequency, Hz, for a compressor 10 operating in a steady state condition. FIG. 11 corresponds to FIG. 10 except that compressor 10 is in a condition of rotating stall.

In comparing FIG. 9 and FIG. 11 it will be noted that when the impeller pressure fluctuation is above 15 psi, high shaft vibrations were obtained. However, as shown in FIGS. 8 and 10, when compressor 10 is not operating in rotating stall, both the pressure fluctuation and shaft vibrations are low. As is clearly shown in FIG. 11, the frequency of the pressure pulsation, and hence the vibrations, is less than 20 Hz. It is not necessary to find the frequency of the pressure pulsations since transducer 40 and the associated circuitry is designed to detect the low frequency signal and transmit the relevant information via line 40-1 to microprocessor 100.

As noted above, rotating stall is within the compressor surge limit so that the surge control algorithm does not necessarily require shutting down compressor 10. If the pressure fluctuation detected by transducer 40 is greater than a predetermined level, eg. 12 psi, an undesirable operating condition exists and the present invention will cause compressor 10 to either be shut down or moved to a different operating condition by varying diffuser 20 and/or inlet guide vanes 16.

Although a preferred embodiment of the present invention has been illustrated and described, other changes will occur to those skilled in the art. For example, while a pipe diffuser has been specifically described, other variable diffusers can be satisfactorily employed with the present invention. Additionally, other structure/sensors may be provided to respond to stall. However, the proper practice of the present invention should prevent the compressor from reaching a stall condition. It is therefore intended that the scope of the present invention is to be limited only by the scope of the appended claims.

What is claimed is:

1. In a centrifugal compressor having a casing, an impeller located in said casing and having a tip:

means for sensing a single parameter which is solely indicative of rotating stall in said compressor; and means for controlling said compressor responsive to said means for sensing said single parameter sensing a value of said single parameter which is indicative of rotating stall.

2. The centrifugal compressor of claim 1 wherein said single parameter is pressure at said impeller tip.

3. The centrifugal compressor of claim 1 wherein said means for controlling includes a variable diffuser.

4. The centrifugal compressor of claim 1 wherein said means for sensing includes a transducer located externally of said compressor.

5. The centrifugal compressor of claim 4 wherein said means for sensing further includes a fluid passage extending from a region near said tip through said casing and fluidly connected to said transducer.

6. A centrifugal compressor having a casing and a flow path therethrough serially including inlet guide vanes, an impeller having a tip and a diffuser characterized by:

transducer means for sensing a pressure and located externally of said casing;

a fluid passage extending from a region near said tip through said casing and fluidly connected to said transducer means;

means for controlling said compressor responsive to pressure variations near said tip which are sensed by said transducer means and which are indicative of rotating stall.

7. A method for protecting a centrifugal compressor having a casing and a flow path therethrough serially including inlet guide vanes, an impeller having a tip and a diffuser from rotating stall vibrations characterized by the steps of:

sensing a pressure near said tip; and controlling said compressor responsive to pressure variations sensed near said tip which are indicative of rotating stall.

* * * * *